US006196333B1

(12) United States Patent
Aardal

(10) Patent No.: US 6,196,333 B1
(45) Date of Patent: Mar. 6, 2001

(54) HYDROSTATIC PENETRATION DEVICE AND TOOL FOR THE SAME

(75) Inventor: Kåre Aardal, Selje (NO)

(73) Assignee: Norcon AG, Chur (CH)

( * ) Notice: Subject to any disclaimer, the term of this patent is extended or adjusted under 35 U.S.C. 154(b) by 0 days.

(21) Appl. No.: 09/284,018

(22) PCT Filed: Oct. 6, 1997

(86) PCT No.: PCT/NO97/00268

§ 371 Date: Apr. 30, 1999

§ 102(e) Date: Apr. 30, 1999

(87) PCT Pub. No.: WO98/15713

PCT Pub. Date: Apr. 16, 1998

(30) Foreign Application Priority Data

Oct. 7, 1996 (NO) ..... 964259

(51) Int. Cl.[7] ..... E21B 7/12
(52) U.S. Cl. ..... 175/5; 175/51
(58) Field of Search ..... 175/50, 5, 6, 7, 175/10, 27, 25, 51

(56) References Cited

U.S. PATENT DOCUMENTS 3,118,417 1/1964 Stanwick .
3,693,730 9/1972 Edigarian et al. .
3,896,667 * 7/1975 Jeter ..... 175/40 X
4,200,158 * 4/1980 Perkins ..... 175/297
4,273,372 * 6/1981 Shestawy ..... 166/215 X
5,060,737 * 10/1991 Mohn ..... 175/104

FOREIGN PATENT DOCUMENTS

WO 92/19836 11/1992 (WO) .
WO 94/23181 10/1994 (WO) .

* cited by examiner

*Primary Examiner*—Frank Tsay
(74) *Attorney, Agent, or Firm*—Young & Thompson

(57) ABSTRACT

A hydrostatic penetration device for placing on and penetration of the seabed comprises a housing (1) with a top cover (2) and a bottom cover (3), and a through-going vertical tool (4) for penetration of the seabed. The hydrostatic penetration device comprises at least one low pressure chamber (5), at least one hydraulic cylinder (6) with a vertically movable piston and piston rod (10) which can be driven to upward and downward movement by a flow of pressurised water from the surrounding water to the low pressure chamber (5), a clamping device (8) which surrounds the tool (4) and is connected to the piston rod (10), and which, during an upward and downward movement of the piston rod can be brought out of and into engagement with the tool respectively, and at least one weight (7) resting on the piston rod, which weight is vertically movable under the influence of the piston rod (10) and is arranged to transfer its weight to the clamping device (8) during a downward movement.

20 Claims, 20 Drawing Sheets

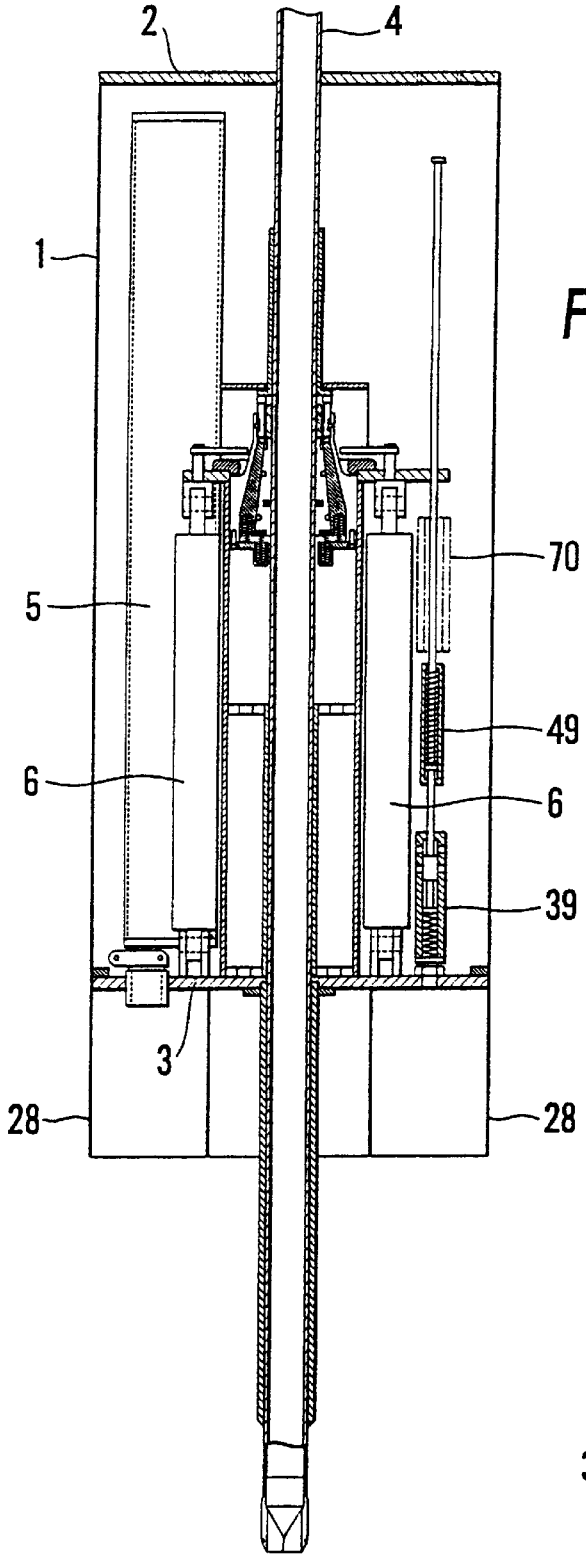
Fig. 12a
Fig. 12b
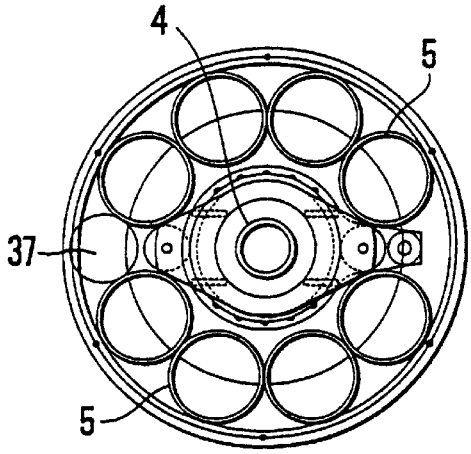

HYDROSTATIC PENETRATION DEVICE AND TOOL FOR THE SAME

BACKGROUND OF THE INVENTION

The invention concerns a hydrostatic penetration device for placing on and penetration of the seabed, comprising a housing with a top cover and a bottom cover, and a through-going vertical tool for penetration of the seabed. The invention also concerns tools for use with a hydrostatic penetration device, especially a sampler for core samples, where the tool is a sampler tube.

In addition to being able to be employed together with the said tools, the hydrostatic penetration device will also be able to be employed to drive a test probe down into the seabed, for measurement of, for example, temperature, mechanical resistance and electrical conductivity.

There are known in the prior art hydrostatic penetration devices in the form of samplers for core samples, e.g. of sediments on the seabed, designed in principle as percussion drill machines, these samplers being operated by the pressure difference between a low pressure chamber provided in the sampler and the ambient hydrostatic pressure. The standard known samplers of this type comprise a head to which the tool or the sampler tube is attached and is driven down into the seabed by a piston provided in a piston cylinder which can be connected to the surrounding water. When the stroke movement is completed, the cylinder is evacuated to the low pressure chamber, and the piston returns to the initial position, whereupon the cycle process is repeated. The weight of the sampler head acts in conjunction with the hydrostatic pressure in order to provide the energy required to perform the stroke movement or the drop stroke. Stability problems often arise with such known samplers when they are equipped with long sampler tubes, and there can also be problems in providing sufficient energy if long sampler tubes are employed.

In order to avoid the drawbacks with known hydrostatic samplers, it has therefore been proposed that the tool or the sampler tube should be through-going in the sampler's head or housing and that the sampler head or housing should be placed on the seabed.

U.S. Pat. No. 3,693,730 describes a sampler in which a housing with an electromagnetic vibrator is placed on the seabed. A through-going tube is driven by means of the vibrator down into the seabed, and a drawworks is used to move the vibrator along the pipe.

SUMMARY OF THE INVENTION

A first object of the present invention is to provide a description of a hydrostatic penetration device of the type mentioned in the introduction, which makes it possible to place the penetration device's housing on the seabed and for the tool to be through-going in the housing.

A second object is to provide a hydrostatically operated penetration device wherein the housing itself has a relatively low weight, while the weight which together with the hydrostatic pressure has to contribute to the drop movement is provided in the form of a weight which is arranged in the housing and is lifted in a return stroke. If the hydrostatic penetration device is employed as a sampler, the stability problems of known samplers are thereby avoided, while at the same time permitting the use of sampler tubes of a far greater length than is possible with the prior art.

A further object of the present invention is that it should be possible to supply energy as required without the occurrence of any stability problems.

Finally, it is an object of the invention to provide suitable tools for use with a hydrostatic penetration device according to the invention.

The objects are achieved with a hydrostatic penetration device and tools of the type mentioned in the introduction which are characterized by the features which are indicated in the claims.

The above-mentioned and other objects are therefore achieved with a hydrostatic penetration device for placing on and penetration of the seabed, comprising a housing with a top cover and a bottom cover, and a through-going vertical tool for penetration of the seabed, and is characterized in that it comprises:

- at least one low pressure chamber with a pressure which is lower than the pressure in the surrounding water,
- at least one hydraulic cylinder with a vertically movable piston and piston rod which can be driven to upward and downward movement by a flow of pressurized water from the surrounding water to the low pressure chamber, pipes and valves for leading and guiding the said flow of pressurized water, for controlling the piston's and thereby the piston rod's movement,
- a clamping device which surrounds the tool and is connected to the piston rod, and which by means of an upward and downward movement of the piston rod can be brought out of and into engagement with the tool,
- at least one vertically movable weight connected to the piston rod, arranged to transfer its weight to the clamping device during a downwardly directed movement, whereby during an upwardly directed movement the piston rod will lift the weight and bring the clamping device out of engagement with the tool, thus causing the clamping device to slide upwards along the tool, and during a subsequent downwardly directed movement will bring the clamping device into engagement with the tool, with the result that, under the influence of the weight and force from the piston rod the tool is driven down into the seabed. A new cycle is then initiated where the piston rod is again moved upwards. The number of cycles which may be performed will depend on the dimensioning of the low pressure chamber, and will typically amount to 50 cycles.

In an embodiment of the invention the cylinder volume above the piston in the hydraulic cylinder is permanently connected to the low pressure chamber, during the piston rod's upward and downward movement the cylinder volume below the piston is connected to the surrounding water and the low pressure chamber respectively, and the housing has at least one opening to the surrounding water, thus causing the piston rod to be exposed to the pressure in the surrounding water.

In an embodiment of the invention the tool is driven down by impacts, the weight dropping during the introductory part of its downwardly directed movement, thus causing it to strike the clamping device, driving the tool down with a blow, which is advantageous in sampling of the seabed, particularly of hard sediments. In a second embodiment of the invention the tool is forced down into the seabed at a constant speed, which is advantageous when the tool is used to convey a test probe down into the seabed.

A first tool for use with a hydrostatic penetration device according to the invention, especially a sampler tube for core samples, is characterized according to the invention in that the sampler tube has a head provided at its lower end with closing jaws hinged to the head with a substantially tubular cross section and toothed gripping surfaces which synchronise the closing jaw's movement.

A second tool for use with a hydrostatic penetration device according to the invention, especially a sampler tube for core samples, is characterized according to the invention in that the sampler tube has provided at its lower end a head in the form of a valve housing with a valve plate and an arm which constitutes a one-way valve which in an open position admits water into the sampler tube.

BRIEF DESCRIPTION OF THE DRAWINGS

The invention will now be explained in more detail in connection with embodiments and as illustrated in the appended drawing.

FIG. 12*a* and FIG. 12*b* illustrate a preferred embodiment of the hydrostatic penetration device according to the present invention.

DETAILED DESCRIPTION OF THE PREFERRED EMBODIMENTS

Figure 1:
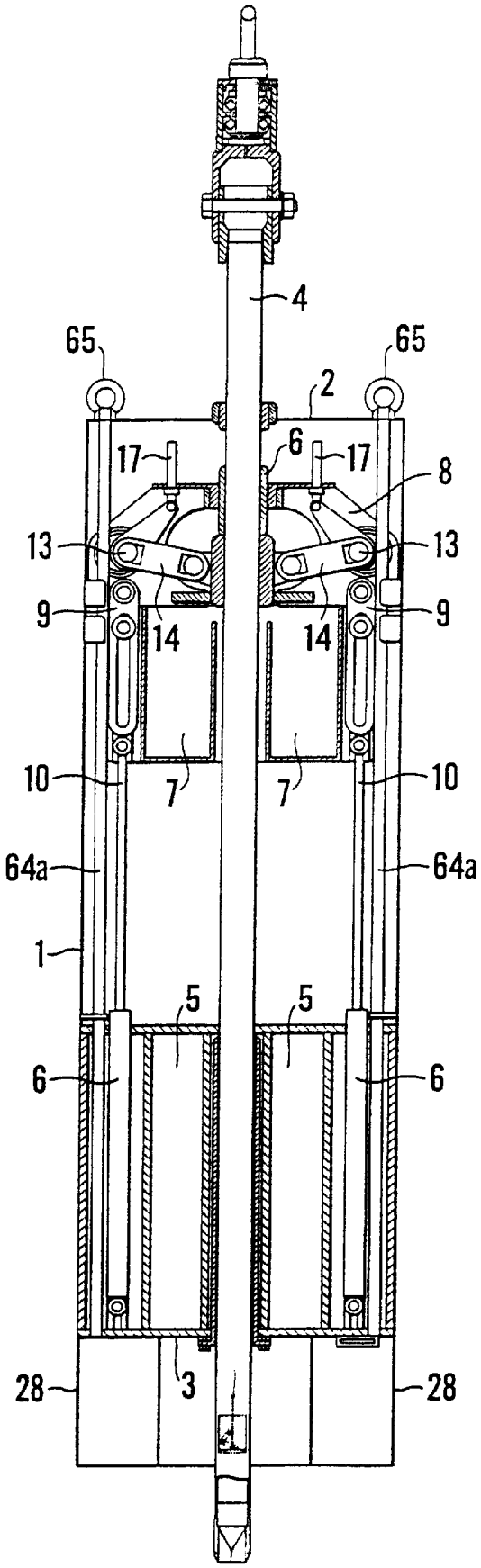
FIG. 1 is a section through a first embodiment of a hydrostatic penetration device according to the invention.

FIG. 1 is a section through a hydrostatic penetration device for placing on and penetration of the seabed, especially a hydrostatic sampler, according to the present invention. The depth of the seabed may be, for example, from 50 meters to several thousand meters, with a depth of a few hundred meters being typical. The actual sampler is provided in a housing 1 with a top cover 2 and a bottom cover 3 and is arranged to receive a through-going tool 4, which in FIG. 1 is a sampler tube or a section of a sampler tube.

In the housing 1 there are provided one or more low pressure chambers 5 with a pressure which is lower than the pressure in the surrounding water. The hydrostatic penetration device will be employed in sea depths which are greater than can easily be reached from the surface, in which case the surrounding water will have a pressure which will be at least several bar. The low pressure chamber 5 must have a pressure which is lower than this. The simplest solution is to have the low pressure chamber at a pressure of 1 bar, which can be achieved by allowing the pressure chamber to stand open to the atmosphere before placing the penetration device on the seabed, but of course it is possible for the pressure chamber to have other pressures.

In the housing there is further provided at least one hydraulic cylinder 6 with a vertically movable piston, not shown, and a piston rod 10 which can be operated for upward and downward movement by a flow of pressurized water from the surrounding water to the low pressure chamber 5. This flow of water is led via pipes and valves in order to control the piston's and thereby the piston rod's 10 movement. The pipes and valves can be provided per se in several ways, but in the following description will be illustrated and discussed in a preferred embodiment.

The piston rod 10 is connected to a vertically movable weight 7 which is provided around the sampler tube 4. The mass of the weight 7 can be adjusted by having the weight 7 composed of several loose weights.

The piston rod 10 and the weight 7 are connected via a link arm 9 to a clamping device 8 which surrounds the tool 4. During a downwardly directed driving phase the clamping device 8 is brought into secure engagement with the sampler tube 4, thus causing the force from the piston rod 10 and the influence of the weight 7 to be transferred to the sampler tube 4. During an upwardly directed return phase the piston rod 10 lifts the weight 7, bringing the clamping device 8 out of engagement with the sampler tube 4, thus causing the clamping device to slide upwards along the sampler tube. At the end of the return phase a valve which will be discussed in more detail later is influenced, thus initiating the piston rod's downward movement. The clamping device 8 is similarly activated at the end of the return phase, locking on to the sampler tube 4.

The entire housing 1 can rest on the seabed and be anchored by means of a skirt 28 which acts as a suction anchor.

Figure 2A:
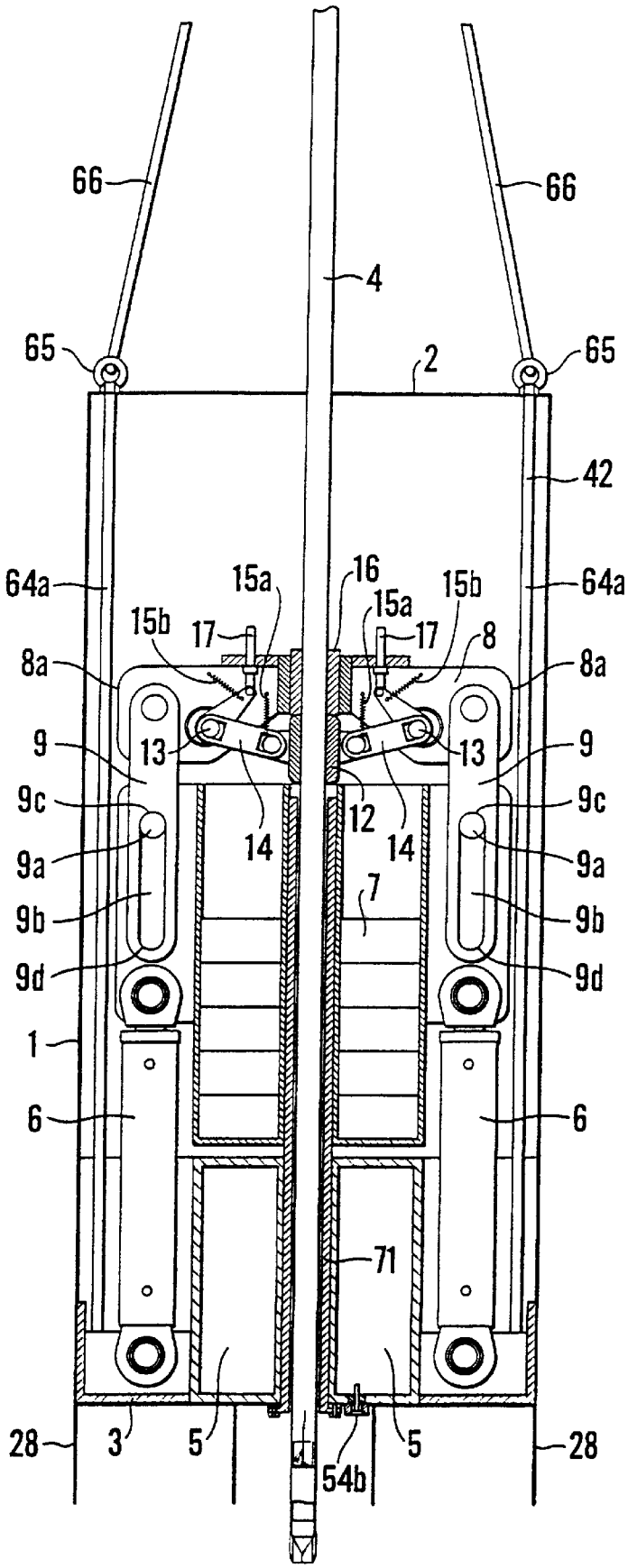
FIG. 2*a* is a more detailed section of the embodiment in FIG. 1.

FIG. 2*a* shows in more detail the design of the sampler in FIG. 1. The clamping device 8 comprises at least one clamp bit 12 which is connected to an eccentric device 13 via at least one link arm 14. When the operation is completed, the sampler tube 4 will in fact be pulled up before the sampler or the housing 1, the eccentric device 13 then releasing the clamping device 8 when the clamping device hits the top cover 2. As illustrated in FIG. 2*a,* there is attached to a bracket 8*a* at least one spring 15*a* which holds the link arm 14 up and the clamp bit 12 against a movable sleeve 16 which is provided around the sampler tube 4, the sleeve 16 forming a stop for the clamp bit 12 and helping to regulate the clamping force. At least one additional spring 15*b* holds the clamp bit 12 in contact with the sampler tube 4, the spring 15*b* connecting the eccentric device 13 with the bracket 8*a*. In the surface which surrounds the sampler tube 4 the clamp bit 12 may be provided with a friction coating or with a toothing device which engages with the sampler tube's surface in order to provide a secure attachment.

As mentioned, the clamping device 8 is activated when the sampler tube 4 is pulled out of the housing 1. For this purpose release bodies 17 are connected with the eccentric device 13, and when these release bodies 17 hit the top cover 2, the eccentric device 13 is rotated and the clamp bit 12 is pulled away from the sampler tube 4.

In the embodiment in FIG. 2*a* the link arm 9 is provided with a groove 9*b* with an upper stop 9*c* and a lower stop 9*d*, and the piston rod 10 and the weight 7 are connected to the link arm 9 by a bolt 9*a* which can be moved in the groove 9*b*. During the return phase the bolt abuts against the upper stop 9*c*, thereby lifting the clamping device along the tube 4. During the first part of the subsequent driving phase the bolt 9*a* can move freely in the groove 9*b*. The piston rod 10 and the weight 7 thereby move rapidly downwards, and, if the water flows sufficiently quickly out of the hydraulic cylinder 6, will almost achieve free fall. When the bolt 9*a* meets the lower stop 9*d* an impact will occur which is transferred from the link arm 9 to the clamping device 8 and the tube 4, with the result that the latter is driven down through the seabed or the bottom sediments.

Furthermore, in the embodiment in FIG. 2*a* there is provided in the lower part of the sampler housing a tubular or sleeve-shaped guide 71 for the sampler tube, which guide 71 may, e.g., be attached via a flange to the bottom plate 3.

Figure 2B:
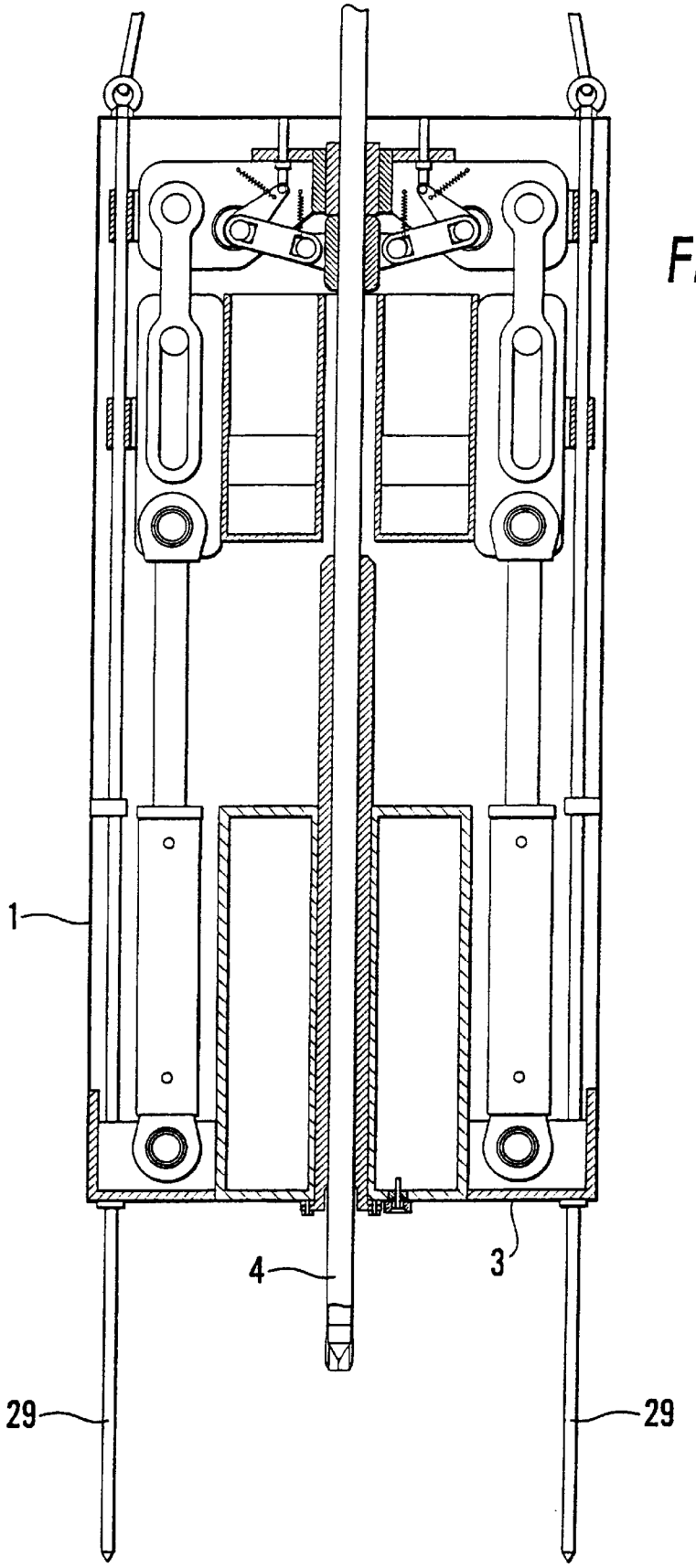
FIG. 2*b* is a variant of the embodiment in FIG. 1.

In the variant in FIG. 2*b*, instead of the suction anchor 28 there are provided, for example, two spears 29 which stabilise the housing 1, anchoring it to the seabed.

Figure 2C:
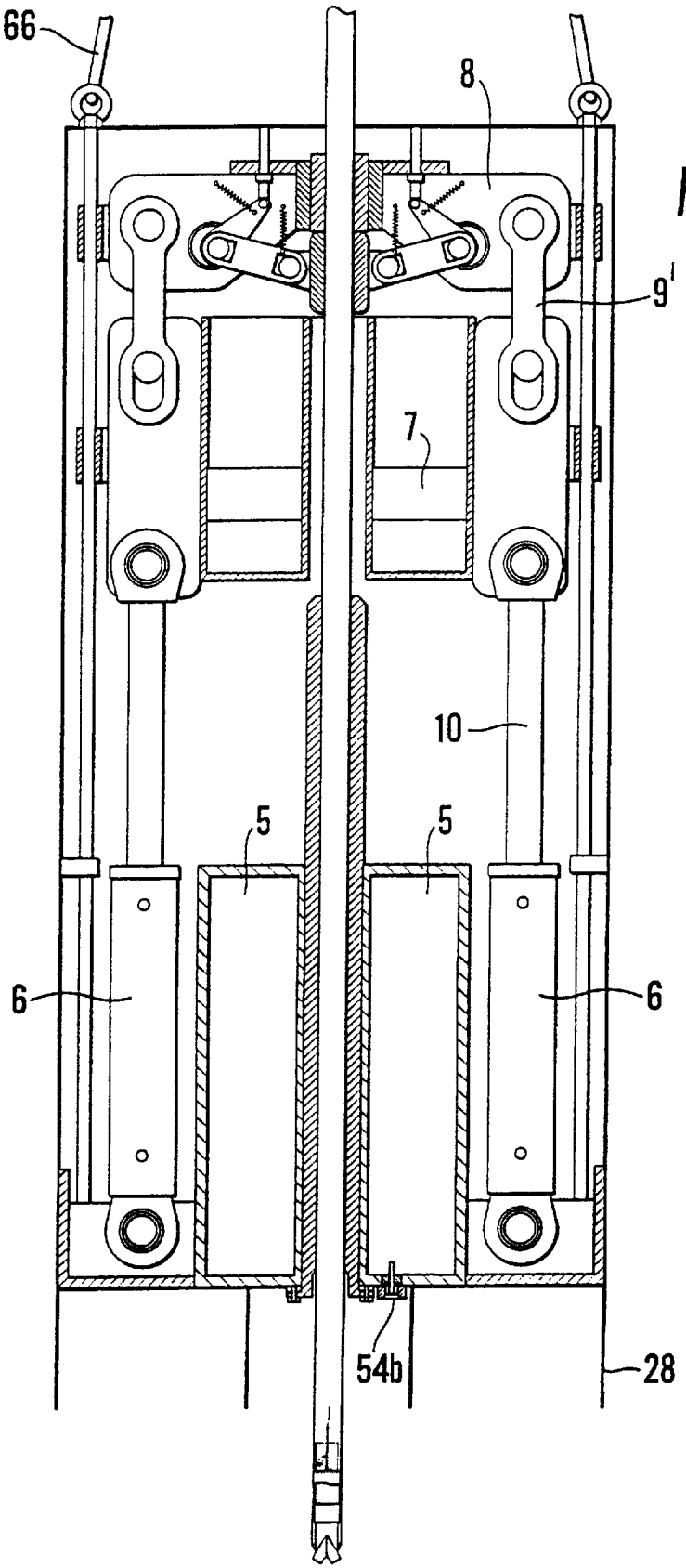
FIG. 2*c* is a second variant of the embodiment in FIG. 1.

FIG. 2*c* illustrates a second variant of the embodiment in FIG. 1, especially intended for use at great depths. Here the link arm 9 is replaced by a link arm 9' which is not provided with grooves, and which thereby connects the clamping device 8 directly with the lifting cylinder 6. In this case the free fall of the weight 7 no longer occurs and the entire stroke length in the lifting cylinder 6 can be employed for driving the sampler tube 4 down into the bottom sediments, since the hydraulic pressure from the pressure difference between the surrounding water and the low pressure chamber is sufficiently great to drive down the sampler tube. This embodiment is particularly advantageous when the hydrostatic penetration device is employed to drive a test probe down into the seabed, since in this case a steady penetration speed of approximately 2 cm/s is required.

The embodiment in FIG. 2*c* is also illustrated with a safety valve 54*b* for the low pressure chamber 5. In this embodiment anchoring must be performed with the suction anchor 28, since otherwise the sampler could be torn away from the seabed during the driving phase.

Figure 3:
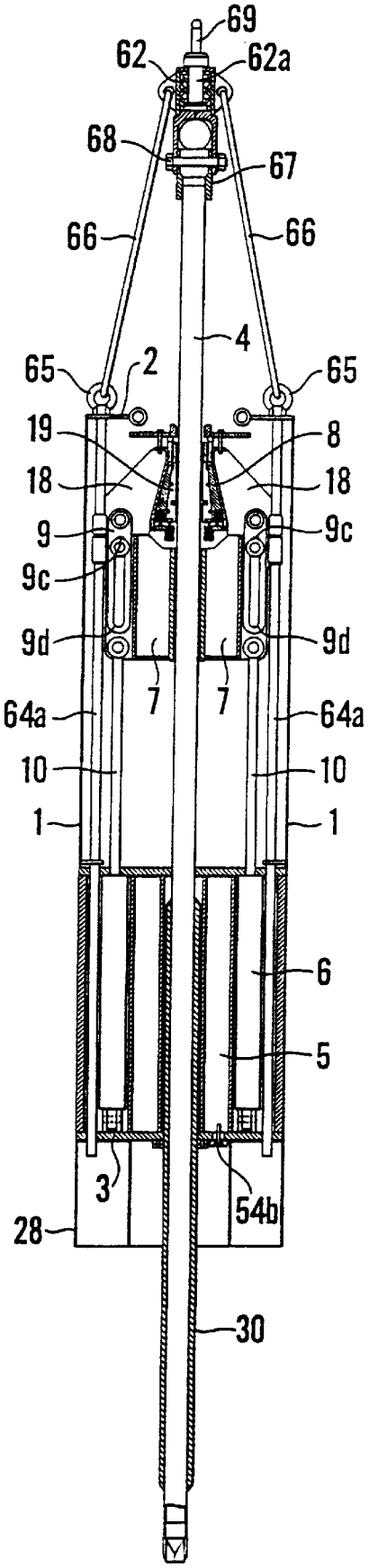
FIG. 3 illustrates a second embodiment of the hydrostatic penetration device according to the invention.

A second embodiment of the hydrostatic penetration device, especially a hydrostatic sampler according to the present invention, is illustrated in FIG. 3. In FIG. 3, and illustrated in more detail in FIG. 4, the sampler has a clamping device 8 which comprises at least one bracket 18, at least one clamp bit 19 in addition to a cone 20 provided between the clamp bit 19 and the bracket 18. The clamp bit 19 is provided in such a manner that it surrounds the tool or the sampler tube 4. Moreover, the clamp bit 19 and the cone 20 are axially at least partially divided up into segments which radially surround the sampler tube 4. Around the sampler tube 4 there may be provided at least one annular disc 21 in the clamp bit 19 and between the clamp bit 19 and the cone 20 a number of springs 22, with the result that the annular disc 21 and the springs 22 hold the clamp bit 19 together with a light pressure on the sampler tube 4. There is provided at least one spring cotter 23 which localises the clamp bit 19 and the cone 20 during the return phase of the stroke movement. A movable casing 24 which constitutes a stop for the clamp bit 19 helps to regulate the axial clearance of the clamp bit 19 relative to the clamping force. The radial forces are thereby restricted during the driving phase of the stroke movement.

In the driving phase of the stroke movement the weight 7 falls free until the bolt 9*a* meets the lower stop 9*d* in the lower end of the groove 9*b* in the link arm 9. The bracket 18 is thereby kept pressed against the cone 20, which in turn presses the clamp bit 19 against the sampler tube 4.

During the return phase of the piston rod 10 the bolt 9*a* abuts against the upper stop 9*c*, thus causing the bracket 18 to be forced upwards, releasing its pressure against the cone 20. In turn the cone 20 thereby loses its pressure against the clamp bit 10, with the result that it disengages with the sampler tube 4, and the entire clamping device 8 is released from the tube 4 and can be moved along it.

Figure 4:
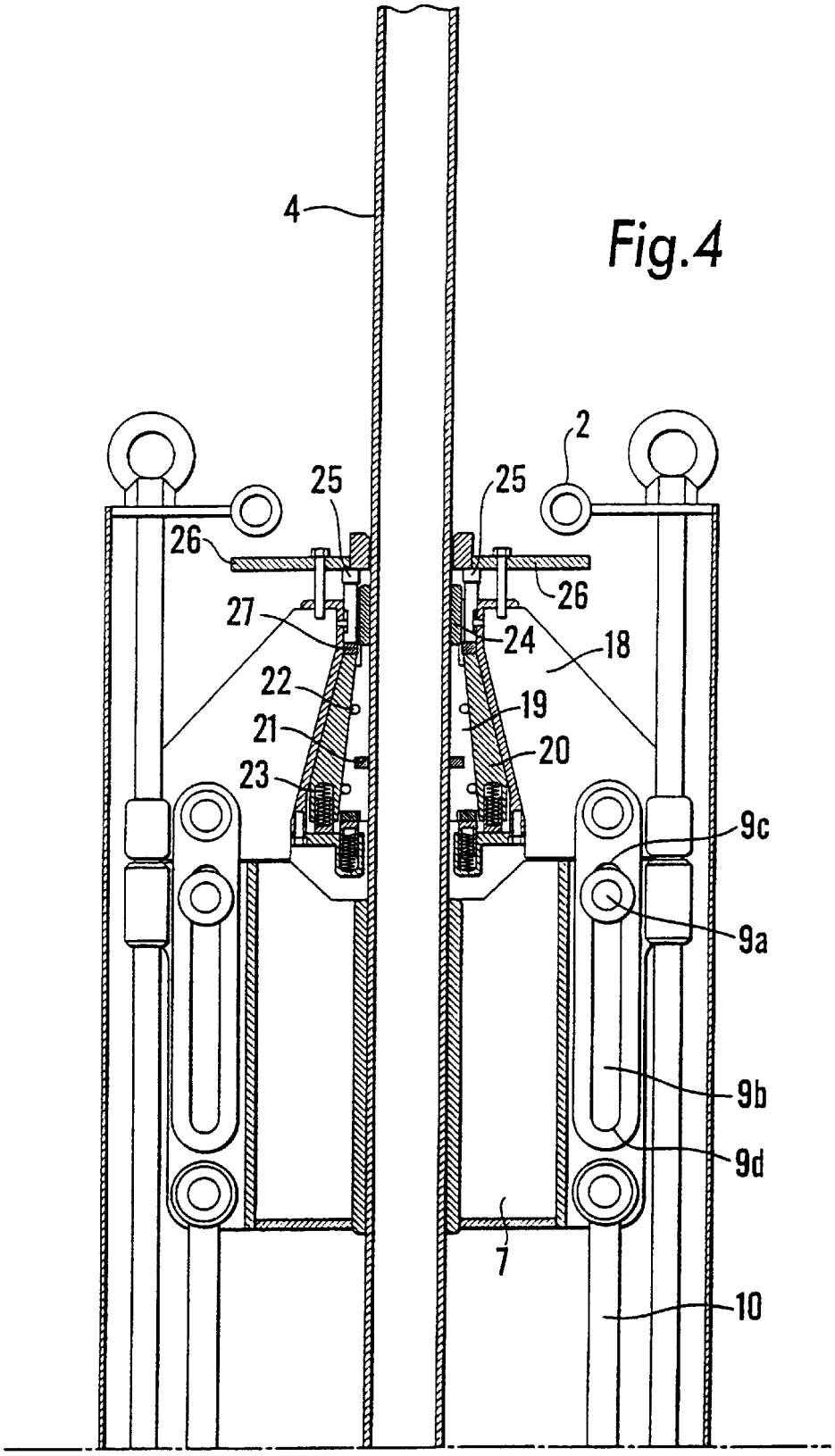
FIG. 4 shows details of the embodiment in FIG. 3.

As shown in FIG. 4, there are connected with the cone 20 release bodies 25 which, when the sampler tube 4 is withdrawn from the seabed, strike a plate 26 provided on the top of the bracket 18 around the tool 4, thus causing the plate 26 to strike the top cover 2, and the release body 25 to be pressed against a ring 27 provided on the top of the cone 20 and around the sampler tube 4. The cone 20 is thereby pushed downwards and the clamp bit 19 away from the sampler tube 4. The sampler tube 4 can thereby be completely withdrawn from the bottom sediment before the sampler is lifted up from the seabed. At the lower end of the sampler the sampler tube 4 is surrounded by a guide casing 30 which is attached to the bottom plate 3.

During the driving phase of the stroke movement the guide casing 30 penetrates down into the seabed, securing and stabilising the sampler.

Figure 5:
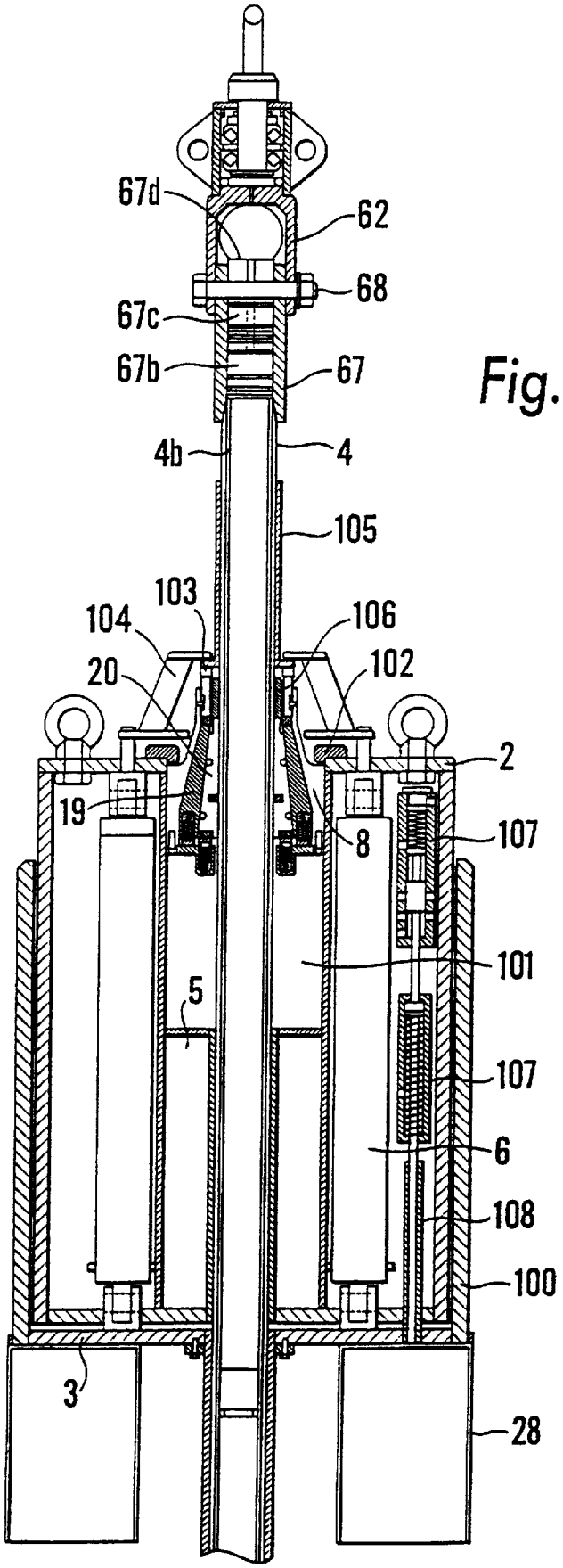
FIG. 5 shows details in a variant of the embodiment in FIG. 3.
Figure 6A:
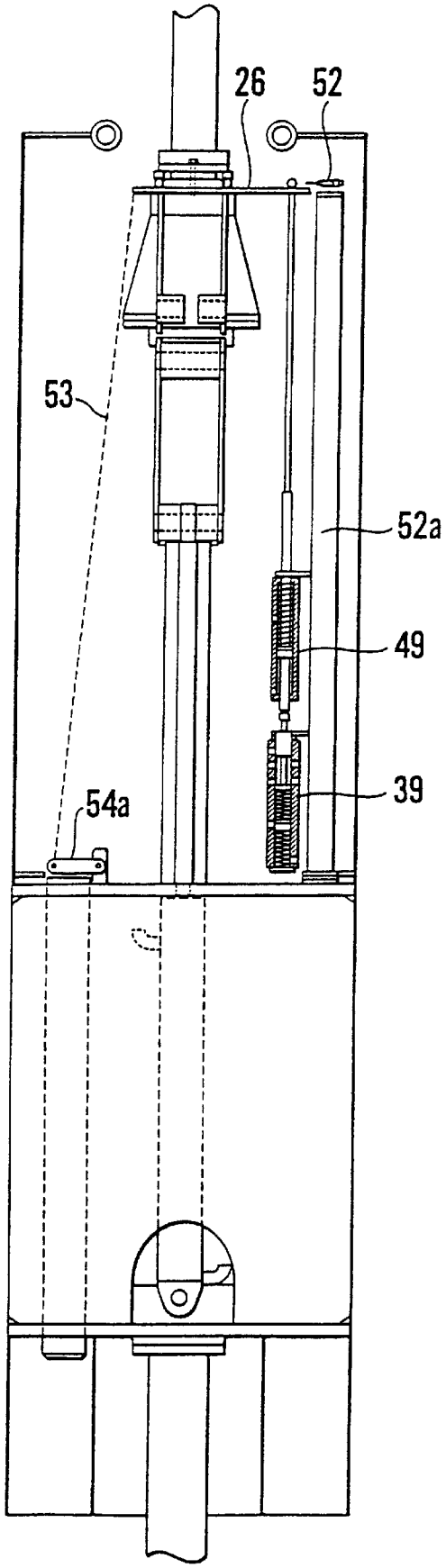
FIG. 6*a* and FIG. 6*b* show details in connection with a suction anchor employed with the present invention and a variant of a valve device for preventing the stroke movement from being activated before the bottom is reached.
Figure 6B:
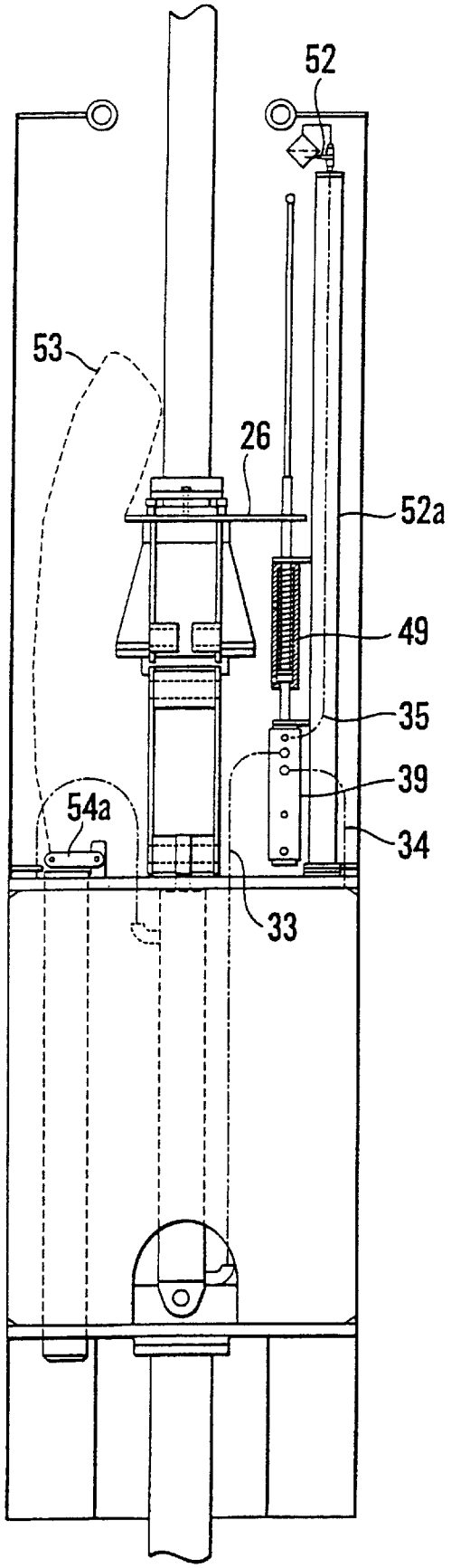

A more compact version of the sampler in FIG. 3 is illustrated in FIG. 5. Here a chamber 101 is provided above the low pressure chamber, thus enabling the clamping device 8 to move in the chamber 101. On the top cover 2 there is provided a ring 102, thus transferring the impact energy in the driving phase of the stroke movement from the ring 102 to the clamping device 8. For uncoupling of the clamp bit 19 there are provided release bodies at the top of the lifting cylinder 6. These release bodies comprise a pin 103, a bracket 104, a casing 105 and release bolts 106. The pin 103 can move freely until the ring 102 strikes the bracket 104. This presses the casings 105 against the release bolts 106, thereby uncoupling the clamp bit 19 and permitting the sampler tube 4 to be withdrawn from the seabed. To prevent foreign objects from penetrating the sampler, i.e. between the low pressure chamber 5 and the bottom cover 3, the sampler casing is surrounded by a basket 100. As shown in FIGS. 6*a* and 6*b*, in this version the sampler is equipped with a valve 52 attached on a valve holder 52*a*. This valve forms part of a valve arrangement 107 which is attached to the lifting cylinder 6 and is controlled by telescopic cylinders 108. This valve arrangement 107 constitutes a variant of the valve control for the hydrostatic penetration device or the sampler according to the invention, the valve control being discussed in more detail with reference to FIGS. 7, 8 and 9.

Figure 7:
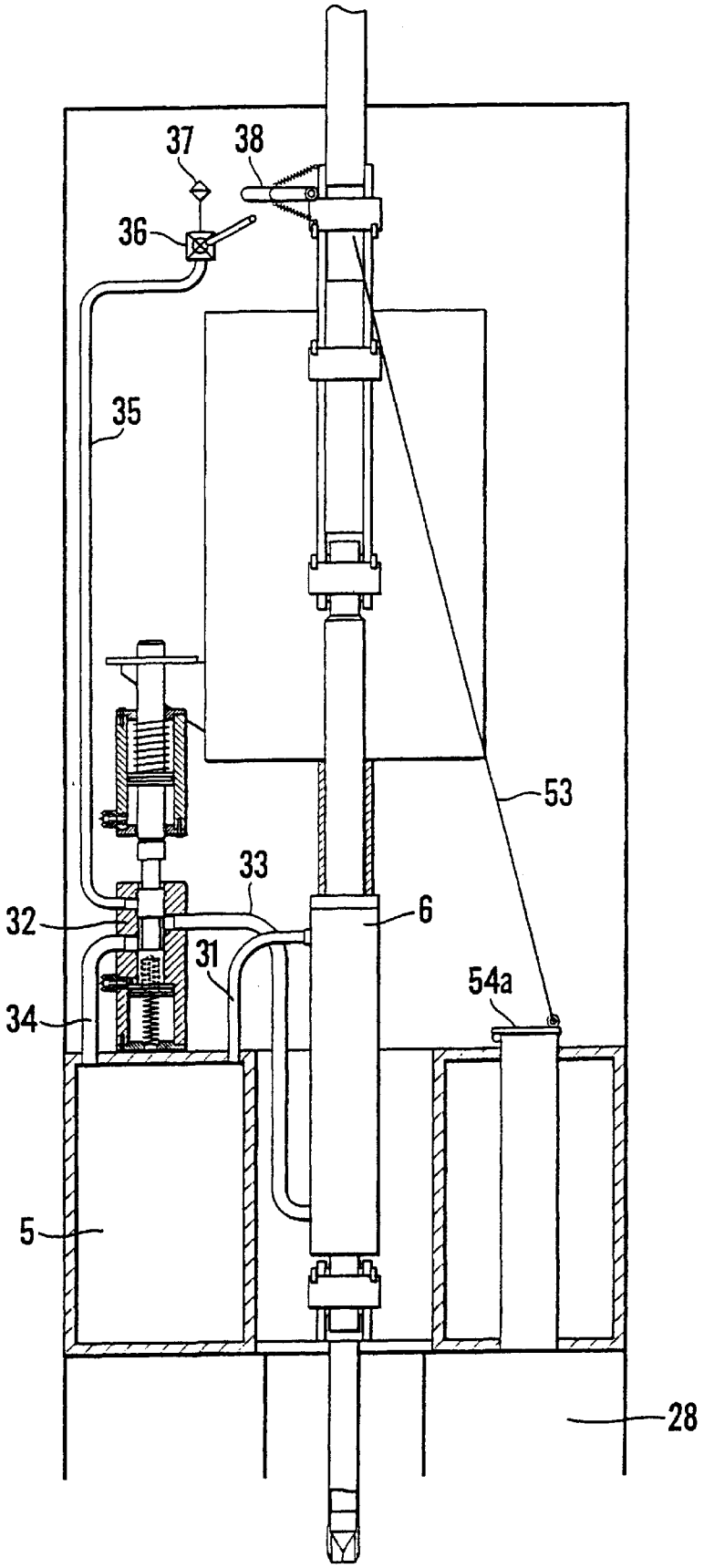
FIG. 7 illustrates the valve gear in the hydrostatic penetration device according to the invention.

FIG. 7 illustrates an embodiment of the penetration device where the cylinder volume above the piston in the hydraulic cylinder 6 is permanently connected to the low pressure chamber 5 via a pipe 31, while the cylinder volume below the piston is connected via a pipe 33 to a valve 32. The valve 32 is connected to the low pressure chamber 5 by a pipe 34, and to the surrounding water by a pipe 35, a valve 36 and a filter 37. The valve 36 can be opened and closed by a rocker arm 38 to prevent the stroke movement during raising and lowering of the sampler. The cylinder volume below the piston in the hydraulic-cylinder 6 can be connected via the valve 32 alternately to the low pressure chamber 5 and the surrounding water.

The housing 1 has at least one opening to the surrounding water (not shown), with the result that the pressure inside the housing is equal to the ambient pressure. This causes the piston rod 10 to be exposed to the ambient pressure, which results in a constant downwardly directed external force on the piston rod, equal to the product of the ambient pressure and the piston rod's area. In addition a constant downwardly directed force is in action which is equal to the product of the pressure above the piston, i.e. the pressure in the low pressure chamber, and the area of the top surface of the piston.

When the cylinder volume above of the piston is connected via the valve 32 to the low pressure chamber 5 an upwardly directed force is generated which is equal to the product of the pressure in the low pressure chamber and the area of the bottom of the piston. Since the ambient pressure at those depths in which the hydrostatic penetration device will be employed is much greater than the pressure in the low pressure chamber, this upwardly directed force will be less than the sum of the two downwardly directed forces, with the result that the piston will be moved downwards.

When the cylinder volume below of the piston is connected via the valve 32 to the surrounding water, an upwardly directed force is generated which is equal to the product of the ambient pressure and the area of the bottom surface of the piston. Applying the same reasoning as above, this force will be greater than the sum of the two downwardly directed forces with the result that the piston will be moved upwards.

The magnitude of the forces will depend on the dimensioning, but with the ambient pressures which prevail at the depths concerned, the piston rod can be made to move in both directions with great force.

This method of control permits the piston rod to be moved in both directions by merely allowing one side of the piston to be exposed to varying pressure. This kind of control is highly advantageous on the seabed, permitting an automated control without the use of electronics.

Figure 8:
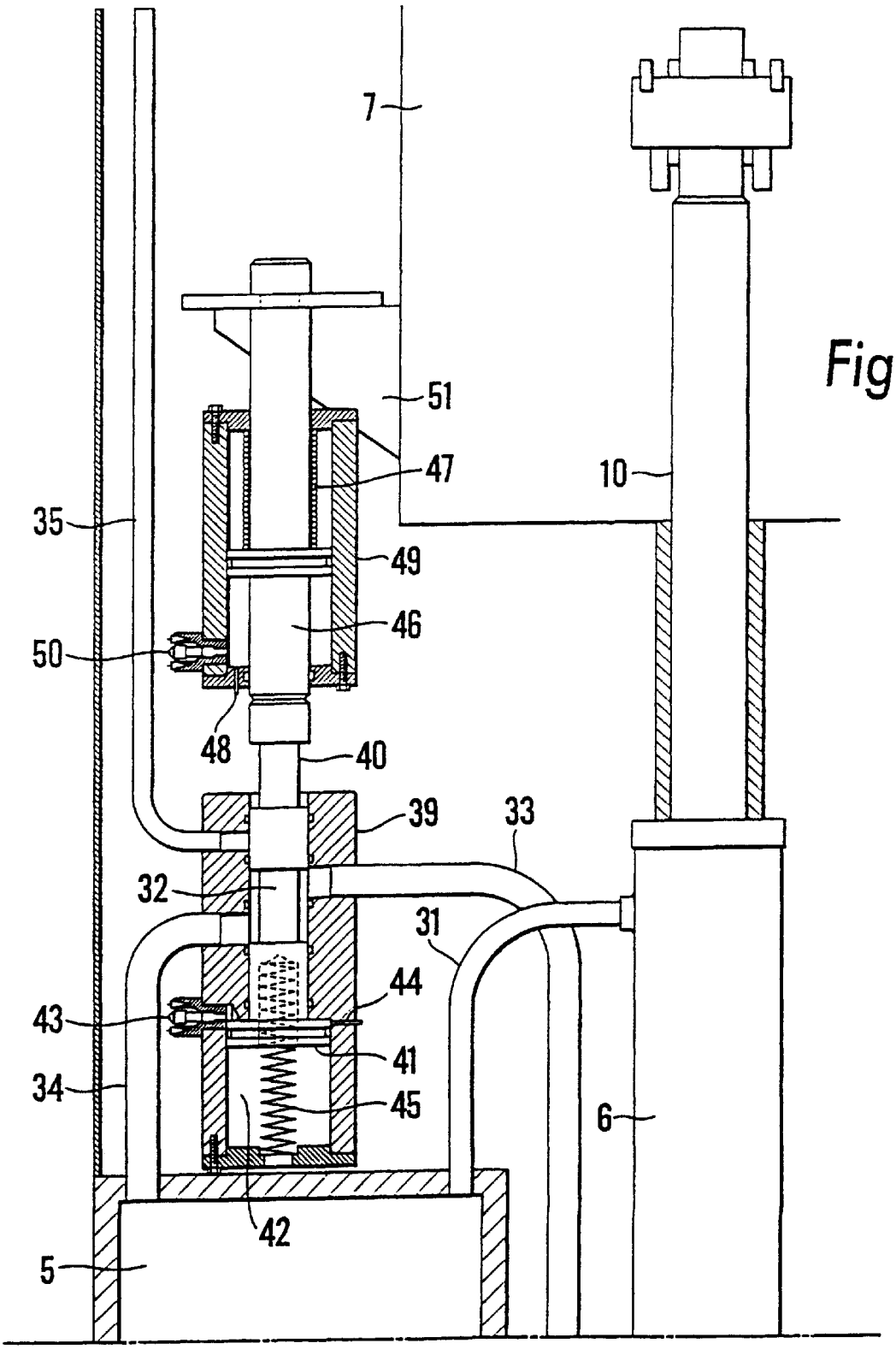
FIG. 8 shows the embodiment in FIG. 7 in more detail.

As illustrated in FIG. 8, the valve 32 comprises a valve housing 39 and has a slide 40 with a piston 41 at one end and is guided in a chamber 42 in the valve housing 39 by a one-way valve 43. The one-way valve 43 provides free movement of the water in one direction, but blocks the water's movement in the opposite direction. The water's movement in this opposite direction is reduced by a choke 44. A spring 45 attempts to force the piston 41 to push water out through the choke 44, the choke 44 thereby regulating the speed of the slide 40 in its upwardly directed movement.

The slide 40 is arranged to be influenced by a slide 46 which is operated by a spring 47 and is regulated via a choke 48, the slide 46 being provided in a housing 49 and moving therein. The housing 49 is equipped with a one-way valve 50 which provides free return when an arm 51 which is operated by the weight 7 lifts the slide 45 and extends the spring 47.

When the driving phase or drop stroke is over, the return phase or return stroke begins, the choke 48 and the valve 50 ensuring that the return stroke does not start until a predetermined period has elapsed. This may be relevant when, e.g., a sample has to be taken of particularly hard sediments, with the result that the sampler does not have sufficient energy in the drop stroke to move the piston rod all the way down, i.e. to utilise the whole stroke length. The time control of the valve in the valve housing 49 ensures, for example, that the return stroke or the return phase can begin even though, e.g., the drop stroke only comprises a quarter of the possible stroke length. In the return stroke the valve 32 opens to the pipe 35 and on to the pipe 33, thus causing the hydraulic cylinder 6 to start the return phase of the stroke movement and lift the weight 7, the clamping device 8 now of course being uncoupled from the sampler tube 4. The valve chamber 42 or the valve 32 is connected to the low pressure chamber 5 via the pipe 34 and is evacuated after the end of the return stroke thereto, thus enabling the driving phase or the drop stroke to start again.

The valve 36 in FIG. 7 also corresponds to the valve 52 in FIGS. 6*a* and 6*b*. The valve 36 or 52 ensures that the stroke movement does not start until the sampler reaches the bottom.

Figure 9:
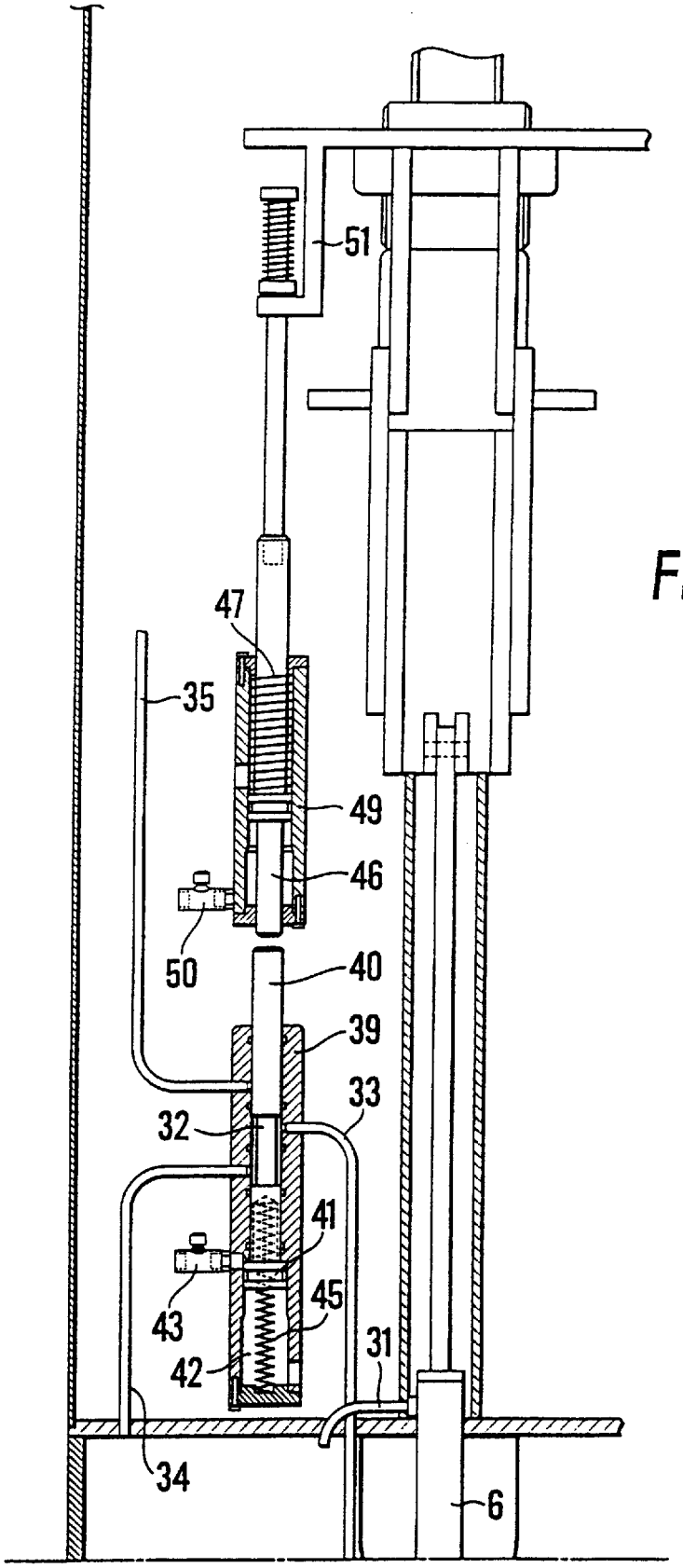
FIG. 9 illustrates a second variant of the valve gear in the hydrostatic penetration device according to the present invention.

FIG. 9 illustrates a slightly divergent design of the valve control shown in FIG. 7 and FIG. 8. Here the chamber 42 in the valve housing 39 is designed with an increase in the diameter of its lower part, with the result that, after a slow introductory movement, the piston 41 moves more rapidly.

When hauling up the hydrostatic sampler the line 53 is drawn tight as shown in FIG. 7, thus opening the valve 54*a* to the suction anchor 28, if this is provided, with the result that a pressure equalisation is obtained when the sampler is pulled up. Similarly, the low pressure chamber 5 may be equipped with a valve 54*b*, see FIG. 2*c*, which ensures pressure equalisation in the low pressure chamber during the pulling up operation.

Before the hydrostatic sampler according to the invention is pulled up, the sampler tube 4 is withdrawn from the sediment and locked in the withdrawn position. The entire sampler can then be hauled up, for example, by means of devices which are illustrated in FIG. 3. Here the top of the sampler tube 4 is attached to a head 67 which is attached by means of a bolt 68 to a swivel housing 62. Wires 66 connect the swivel housing 62 to eyebolts 65 on the top cover 2 of the sampler, and the eyebolts 65 are connected via stays 64*a* to the low pressure chamber 5 for raising and lowering of the sampler. In the swivel housing 62 there is mounted a swivel shaft 62*a*, the swivel shaft 62*a* being locked to a lift eye 69 for attachment of a tricing line which can run between a tower at the top of the sampler, the tower being composed of sections which have a length which at least corresponds to a sampler tube, this being discussed in more detail with reference to FIG. 17. The top of the tower thus forms a carrier for the swivel housing 62 in order to lift the sampler into a vertical position. The sampler housing 1 may be equipped with a number of fastening means on the side, thus enabling the entire sampler and the tower to be lifted into a horizontal position, while at the same time the tower constitutes a support for the tool or the sampler tube 4.

Figure 10A:
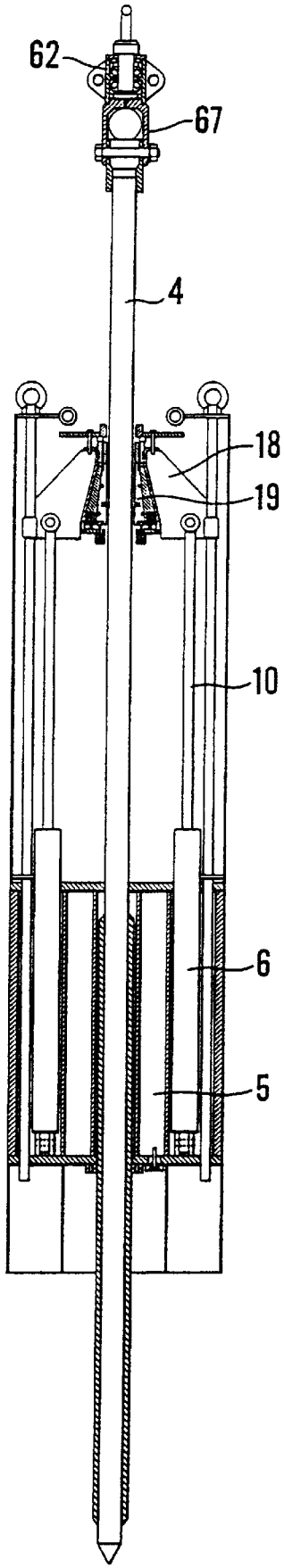
FIG. 10*a* and FIG. 10*b* illustrate the hydrostatic penetration device according to the present invention employed with a passive test probe.
Figure 10B:
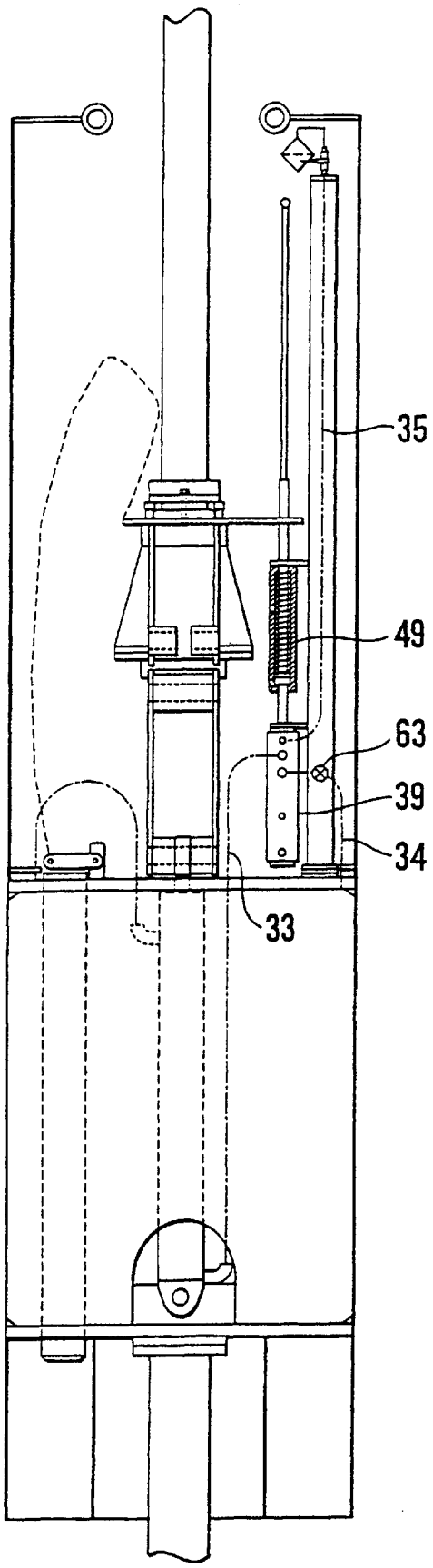

As illustrated in FIGS. 10*a* and 10*b*, the hydrostatic penetration device according to the invention can also be employed as a passive test probe for a "cone penetration test" (CPT). For this purpose the piston rod 10 is attached to the bracket 18 without the use of link arms. The clamp bit 19 and the head 67 are adapted to the CPT probe. On the return pipe 34 to the low pressure chamber 5 there is provided a flow control valve 63 in order to attain constant stroke speed. Otherwise the embodiment may be similar to the embodiment in FIG. 3.

Figure 11:
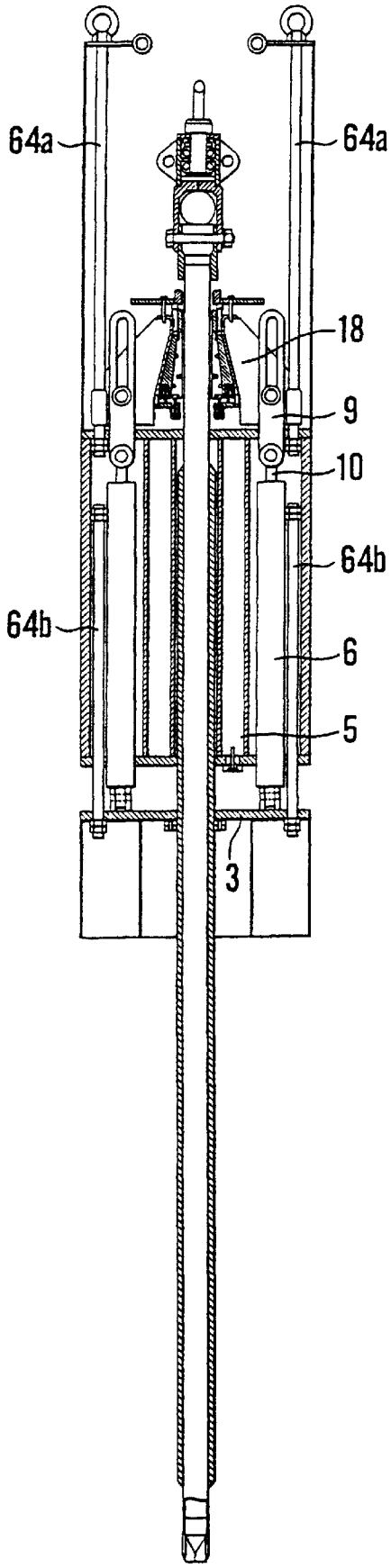
FIG. 11 illustrates an embodiment of the hydrostatic penetration device according to the present invention.

FIG. 11 illustrates an embodiment where the housing including the low pressure chamber is employed as extra stroke weight. Here the hydraulic cylinder 6 is attached at its lower end to the bottom cover 3, which in this design is movable in relation to the rest of the housing 1. The piston rod 10 is attached to the housing 1 and the low pressure chamber 5. The link arm 9 is attached to the low pressure chamber at the lower end and to the bracket 18 at its upper end. The stays 64*b* act as a guide between the low pressure chamber 5 and the bottom cover 3. Thus during a downwardly directed movement of the piston rod 10 both the housing I and the low pressure chamber 5 will contribute to the downwardly directed force with their weight. In addition to the fact that the inertia of the mass of the housing and the low pressure chamber transfer an impact to the tool or the tube, the mass of the water which is located inside the housing and the low pressure chamber will contribute to the impact with its inertia. Otherwise the functions are similar to those in the embodiment in FIG. 3.

A preferred embodiment of the sampler according to the invention is illustrated in FIG. 12*a* in sectional elevation and FIG. 12*b* in cross section. In FIG. 12*a* the return spring 47 (FIG. 8) is reinforced by a weight 70. The low pressure chamber is provided in the form of a number of cylinders 5 around the sampler tube 4, as shown in FIG. 12*b*, where eight low pressure chambers 5 are illustrated. In the embodiment in FIG. 12 a filter is realised in a special manner and indicated by 37 in FIG. 12*b*.

Figure 13:
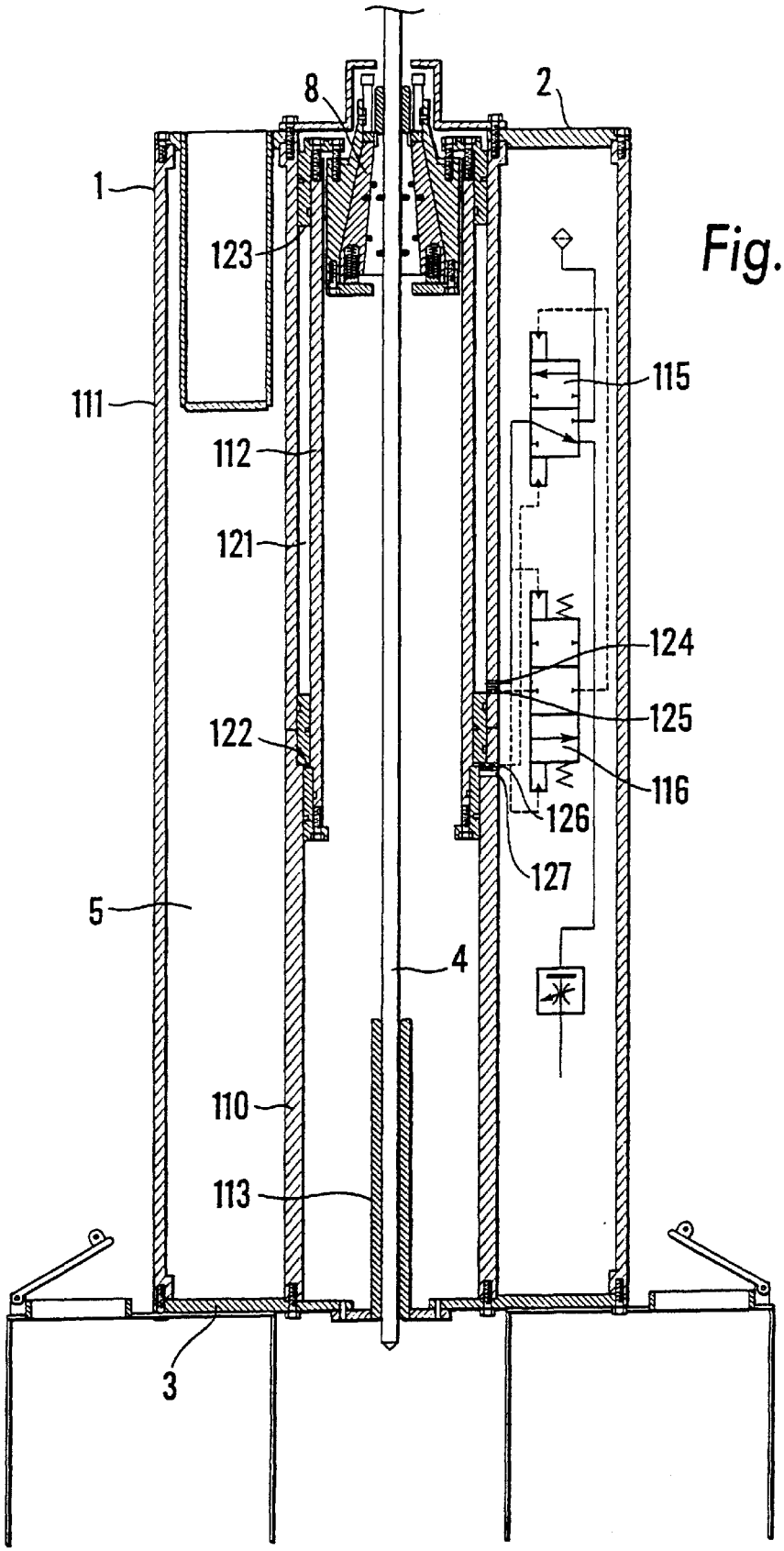
FIG. 13 illustrates a further embodiment of the hydrostatic penetration device according to the present invention, with the piston rod in the upper position.
Figure 14:
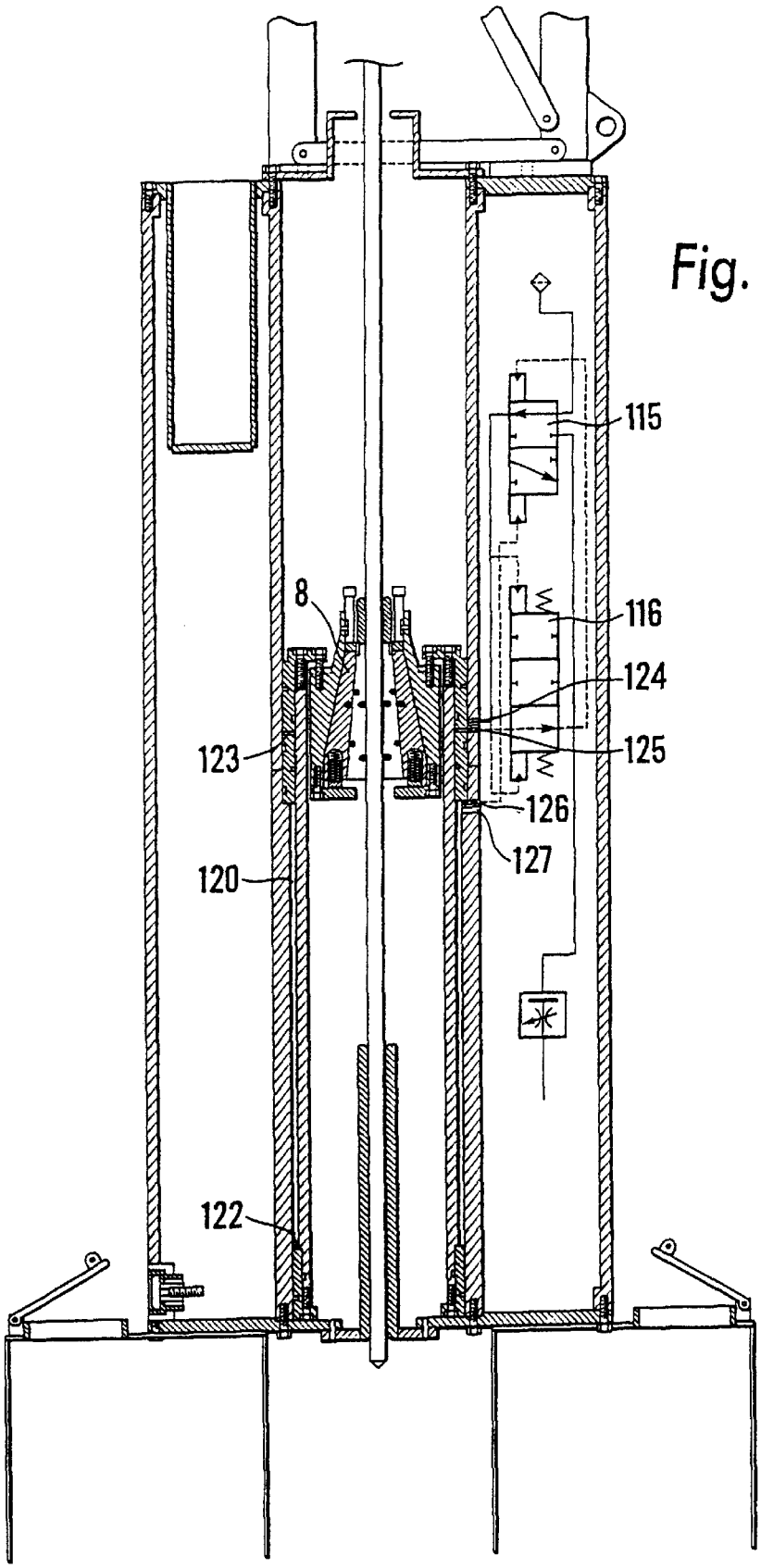
FIG. 14 illustrates the hydrostatic penetration device in FIG. 13 with the piston rod in the lower position.

FIGS. 13 and 14 illustrate an alternative embodiment of the hydrostatic penetration device according to the invention. Here the hydraulic cylinder is designed as a centrally placed cylinder 110 in the housing 1. Together with an external casing 111, the top cover 2 and the bottom cover 3 the hydraulic cylinder 110 defines the low pressure chamber 5. The weight and the piston rod are composed of a cylinder 112 provided inside the hydraulic cylinder 110, and the piston is composed of diametrical gradations of the piston rod 112, the diametrical gradations of the piston rod 112 together with corresponding gradations of the hydraulic cylinder 110 and the walls of the hydraulic cylinder and the piston rod defining variable cylinder volumes. The tool 4 is conveyed in guides 113 along the piston rod's 112 centre line, and the clamping device 8 is attached in the piston rod 112.

A first variable cylinder volume 120 is permanently connected to the low pressure chamber 5 via an outlet 127. The piston in this first variable cylinder volume 120 is composed of a first diametrical gradation 122 of the piston rod 112. A second variable cylinder volume 121 is alternately connected to the low pressure chamber 5 and the surrounding water via an outlet 124 which is connected to valves 115 and 116. The piston in this second variable cylinder volume 121 is composed of a second diametrical gradation 123 of the piston rod 112. The first and second gradations are arranged in such a manner that the first variable cylinder volume 120 decreases when the second variable cylinder volume 121 increases, and vice versa. This is achieved by having the first and second gradations oppositely directed, with the result that a pressure on the first diametrical gradation 122 will attempt to force the piston rod 112 downwards, while a pressure on the second diametrical gradation 123 will attempt to force the piston rod upwards.

The first diametrical gradation 122 forms a piston surface with a first cross section, and the second diametrical gradation 123 forms a piston surface with a second cross section which is larger than the first cross section. By this means the same advantageous control is obtained of the piston rod's movement as was described in connection with FIG. 7.

In order to control the connection between the second variable cylinder volume 121 and the low pressure chamber 5 and the surrounding water respectively, the control of the valves 115 and 116 is performed by means of impulses from impulse couplings 125 and 126 from the second and first variable cylinder volumes respectively. The impulse from the first cylinder volume 120 occurs when the piston rod 112 has moved to its upper position, see FIG. 13, with the result that the gradation 122 blocks the outlet 127 from the first cylinder volume. Remaining fluid which is located in the first cylinder volume will thereby be compressed, giving an impulse through the impulse coupling 126. This impulse is used to control the valves 115 and 116, which is prior art and will not be described further, thus connecting the outlet 124 of the second cylinder volume 121 to the low pressure chamber 5. This causes the piston rod to move downwards to its lower position during its driving phase, see FIG. 14, where the second diametrical gradation 123 blocks the outlet 124. Remaining fluid which is located in the second cylinder volume will thereby be compressed, giving an impulse through the impulse coupling 125. This impulse causes the valves 115 and 116 to connect the second variable cylinder volume 121 to the surrounding water, thus moving the piston rod upwards. In addition to the surrounding water being supplied through the outlet 124, it is also supplied through the impulse coupling 125, since the outlet 124 is closed by the second diametrical gradation 123 when the piston rod 112 is located in its lower position.

Figure 15:
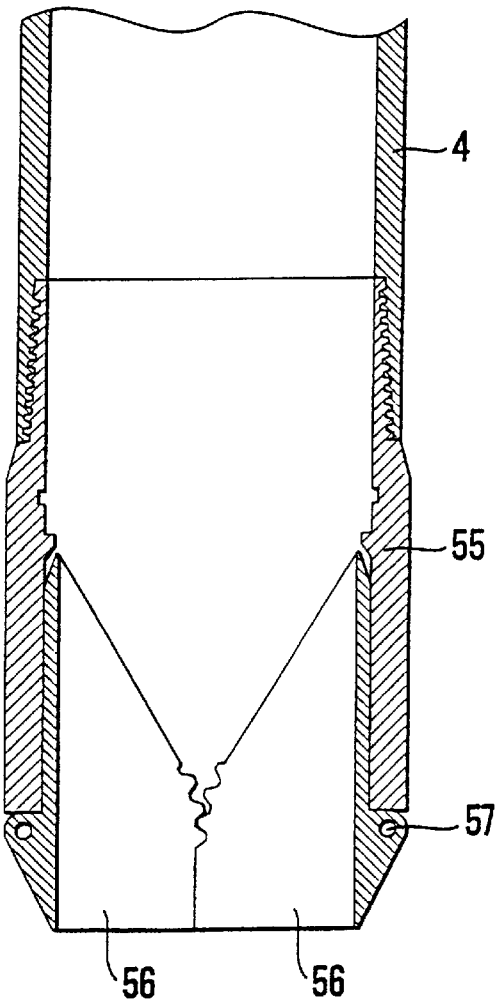
FIG. 15 illustrates an embodiment of a first tool for use in the hydrostatic penetration device according to the present invention.

In connection with FIG. 15 a special tool will now be described for use with the invention, namely a sampler tube 4 at the lower end of which is provided a head 55 with two closing jaws 56 hinged to the head with a substantially tubular cross section and toothed gripping surfaces which synchronise the closing jaw's movement. The hinging is provided by a pin 57. When the sampler tube 4 is withdrawn from the bottom sediment, the bore core is cut by the closing jaws 5*b* and held in the sampler tube 4 while pulling up is in progress.

Figure 16:
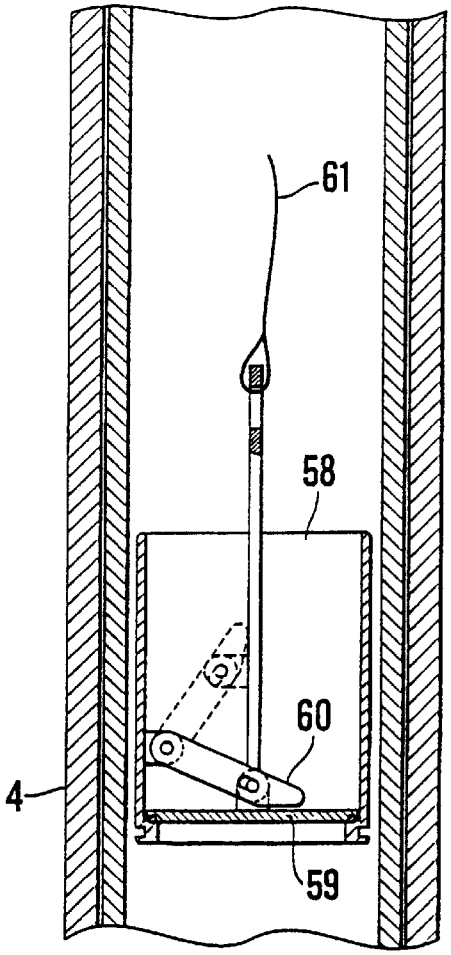
FIG. 16 illustrates an embodiment of a second tool for use in a hydrostatic penetration device according to the present invention.

In a second embodiment illustrated in FIG. 16 the tool is similarly a sampler tube 4, but equipped with a valve, with the result that in the sampler tube there is created an underpressure which sucks up the bore core. This is a so-called "piston corer". In this embodiment the sampler tube 4 has a head 58 provided at its lower end in the form of a valve housing with a valve plate 59 and an arm 60 which constitutes a one-way valve which in an open position admits water through the sampler tube 4, thus permitting water inside the tube to flow upwards during the tube's downwardly directed movement. The valve is attached via the line 61 to, e.g., the top of a tower.

Figure 17:
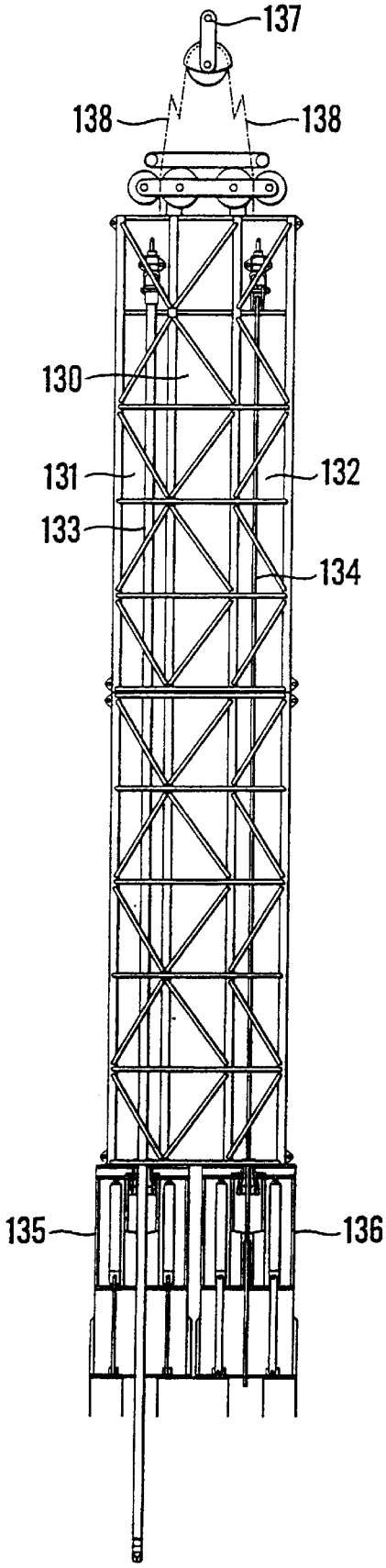
FIG. 17 illustrates a double tower consisting of a shaft or a course for a hydrostatic sampler and a course for a tool for a test probe for measuring mechanical and/or electrical resistance together with temperature in the seabed.

FIG. 17 shows a double tower 130 consisting of a shaft or a course 131 for a sampler tube with swivel, and a corresponding course 132 for a tool for a test probe for measuring mechanical or electrical resistance in the seabed. The lower end of the tower 130 is attached to two housings 135, 136 for hydrostatic penetration devices for the sampler and the tool for the test probe respectively. A wire 138 runs via a block 137 between a sampler tube 133 and a test probe 134. The courses 131, 132 have lengths which correspond to the lengths of the respective penetration tubes or tools, thus enabling the penetration tubes to be pulled up into the tower. The sampler tube 133 is pulled up in the course 131, and the test probe 134 is pulled up in the course 132. The tower 130 can be lifted aboard a vessel by means of a lifting wire which is attached in the block 137.

With a hydrostatic penetration device or sampler according to the present invention it is possible to employ tools and sampler tubes with different diameters, and in this case parts of the clamping device 8, including the clamp bit 12, 19 together with the guide casing 71 have to be replaced by similar components adapted to the tool's altered diameter. In the embodiment in FIG. 1, e.g., the link arm 14 and the casing 16 also have to be replaced and in the embodiment in FIG. 3 the casing 24 and possibly the plate 26.

The hydrostatic penetration device according to the present invention is preferably operated from a vessel, in which case replacement of tools or sampler tubes is performed on board the vessel after the penetration device or the sampler has been hauled up. If, e.g., a sampler is employed to take a core sample of sediments on the seabed, the sampler is hauled up for extraction of the core sample from the sampler tube 4 on board the vessel. This operation does not form part of the invention, and is therefore not shown in any of the figures, but nevertheless it will be described briefly with reference to FIG. 5 in order to exemplify the use of tools in the form of sampler tubes as illustrated in FIG. 15. After the sampler has been hauled up into the vessel, the head 55 is screwed off the sampler tube 4. The bolt 68 is then removed from the swivel housing 62 on the top of the sampler tube and the swivel housing 62 is removed. A piston 67*b* is inserted in the cylindrical head 67. A rear seal 67*c* is then mounted with the bolt 68 as locking. Water under pressure is pumped into a connection 67*d*, forcing the piston 67*b* against a liner 4*b* which is a plastic tube which is located inside the sampler tube 4, surrounding the seabed sample. The liner 4*b* with the seabed sample is then expelled from the sampler tube 4 for subsequent cutting and sealing.

Even though the hydrostatic penetration device with associated tools is illustrated and described in the above as a hydrostatic sampler, a number of variants may be realised both of the hydrostatic penetration device and the tools employed therein for a variety of purposes and within the scope of the present invention. The described embodiments should therefore by no means be considered as limiting for the invention.

What is claimed is:

1. A hydrostatic penetration device for placing on and penetration of the seabed, comprising a housing (1) with a top cover (2) and a bottom cover (3), and a through-going vertical tool (4) for penetration of the seabed, characterized in that it comprises:

at least one low pressure chamber (5) with a pressure which is lower than the pressure in the surrounding water, at least one hydraulic cylinder (6) with a vertically movable piston and piston rod (10) which can be operated for an upward and downward movement by a flow of pressurised water from the surrounding water to the low pressure chamber (5), pipes and valves for leading and controlling said flow of pressurised water, for control of the piston's and thereby the piston rod's (10) movement, a clamping device (8) which surrounds the tool (4) and is connected to the piston rod (10), and which by means of an upward and downward movement of the piston rod can be brought out of and into engagement with the tool respectively, at least one vertically movable weight (7) connected to the piston rod, arranged to transfer its weight to the clamping device (8) during a downward movement, whereby during an upward movement the piston rod (10) will lift the weight (7) and bring the clamping device (8) out of engagement with the tool (4), thus causing the clamping device to slide upwards along the tool, and during a subsequent downward movement will bring the clamping device (8) into engagement with the tool (4), with the result that under the influence of the weight (7) and force from the piston rod (10) the tool is driven down into the seabed.

2. A hydrostatic penetration device according to claim 1, characterized in that the cylinder volume above the piston in the hydraulic cylinder (6) is permanently connected to the low pressure chamber (5), that the cylinder volume below the piston during the piston rod's (10) upward and downward movement is connected to the surrounding water and the low pressure chamber (5) respectively, and that the housing (1) has at least one opening to the surrounding water, thus causing the piston rod to be exposed to the pressure in the surrounding water.

3. A hydrostatic penetration device according to claim 1, characterized in that the clamping device (8) comprises clamp bits (12) which are clamped by spring-loaded link arms (14) against the tool (4), and that the link arms (14) are connected, possibly via connecting links (9, 13, 8*a*), to the piston rod (10), in order to pull the clamp bits (12) away from the tool when the piston rod is located in its upper position.

4. A hydrostatic penetration device according to claim 1, characterized in that the clamping device (8) comprises at least one conical clamp bit (19) which is at least partially divided up into axial segments and arranged around the tool (4), at least one cone (20) which is at least partially divided up into axial segments and arranged outside the clamp bit (19), both the clamp bit (19) and the cone (20) extending downwards, and at least one bracket (18) arranged outside the cone and connected to the piston rod (10) and which during a downwardly directed movement of the piston rod (10) is caused to clamp the cone (20) against the clamp bit (19), with the result that the clamping device (8) is locked to the tool (4).

5. A hydrostatic penetration device according to claim 4, characterized in that around the tool (4) there is provided at least one annular disc (21) in the clamp bit (19) and between the clamp bit (19) and the cone (20) a number of springs (22), with the result that the annular disc (21) and the springs (22) hold the clamp bit (19) together with a light pressure against the tool (4).

6. A hydrostatic penetration device according to claim 1, characterized in that the piston rod (10) and the weight (7) are mutually axially secured, while at the same time they are axially movably (9*b*) connected to the clamping device (8) with an upper stop (9*c*) and lower stop (9*d*), with the result that during an upwardly directed movement the piston rod (10) and the weight (7) will abut against the upper stop (9*c*), bringing the clamping device (8) out of engagement with the tool (4), and during a downwardly directed movement will leave the upper stop, with the result that the clamping device (8) is moved into engagement, after which it drops to the lower stop (9*d*), thus causing an impact to be transferred to the clamping device and the tool.

7. A hydrostatic penetration device according to claim 1, characterized in that release bodies (17, 25) for the clamping device (8) are connected to the top cover (2), with the result that when the tool (4) is pulled up, thus moving the clamping device towards the top cover (2), the clamping device (8) will be brought out of engagement with the tool (4).

8. A hydrostatic penetration device according to claim 1, characterized in that hoses or pipes from the cylinder volume below the piston in the hydraulic cylinder (6) are passed to a valve (32) which in turn is connected to the low pressure chamber (5) and the surrounding water, and that the valve (32) is provided with a pretensioning device (47, 70) which presses the valve into a position where the connection to the low pressure chamber (5) is closed and the connection between the cylinder volume below the piston in the hydraulic cylinder (6) and the surrounding water is open, thus causing the piston and the piston rod (10) to be moved upwards.

9. A hydrostatic penetration device according to claim 8, characterized in that an arm (51), which is securely connected to the weight (7) or the piston rod (10), is arranged in such a manner that, when the piston rod (10) is located in its upper position, it overrules the pretensioning device (47, 70) and steers the valve (32) to a position where the connection to the surrounding water is closed and the connection between the cylinder volume below the piston and the low pressure chamber (5) is open, thus causing the piston and the piston rod (10) to be moved downwards.

10. A hydrostatic penetration device according to claim 9, characterized in that the valve (32) is provided with a time delay device which delays its movement towards the position where the connection to the low pressure chamber (5) is closed and the connection between the cylinder volume below the piston in the hydraulic cylinder (6) and the surrounding water is open.

11. A hydrostatic penetration device according to claim 10, characterized in that the time delay device is composed of a slide (46) which moves in a housing (49) and which is impelled by a spring (47) to force water out of the valve housing (49) through a choke (48), and a one-way valve (50) which admits water into the housing (49) when, under the influence of the arm (51), the slide is moved in the opposite direction.

12. A hydrostatic penetration device according to claim 8, characterized in that the valve (32) comprises a valve housing (39) with a slide (40) which has a piston (41) which is operated by a spring (45) at one end and which in a chamber (42) in the valve housing (39) is controlled by a one-way valve (43) which provides a free movement of the water in one direction, and a choke (44) which chokes the movement of the water in the opposite direction.

13. A hydrostatic penetration device according to claim 1, characterized in that an arm (38) or plate (26) which is securely connected to the clamping device (8) is arranged to close a valve (36, 52) for intake of surrounding water to the hydraulic cylinder (6) when the clamping device (8), during a phase where the housing (1) is suspended in the tool (4), has been pulled up towards the top cover (2).

14. A hydrostatic penetration device according to claim 1, characterized in that the bottom of the bottom cover (3) is provided with a suction anchor (28) for attachment to the seabed.

15. A hydrostatic penetration device according to claim 1, characterized in that the bottom of the bottom cover (3) is provided with at least one spear (29) for attachment to the seabed.

16. A hydrostatic penetration device according to claim 1, characterized in that the bottom cover (3) is provided vertically movable in relation to the housing (1) and attached to the hydraulic cylinder (6), and that the housing (1) and the low pressure chamber (5) are attached to the piston rod (10), whereby the housing (1), the low pressure chamber (5) and water which is located in the housing will supply the clamping device (8) and the tool (4) with percussive energy during the piston rod's downwardly directed movement.

17. A hydrostatic penetration device according to claim 1, characterized in that the hydraulic cylinder is designed as a centrally located cylinder ( 10) in the housing (1) and together with an external casing (111), the top cover (2) and the bottom cover (3) define the low pressure chamber (5), that the weight and the piston rod are composed of a cylinder (112) provided inside the hydraulic cylinder (110), that the piston is composed of diametrical gradations of the piston rod (112), the diametrical gradations of the piston rod (112) together with corresponding gradations of the hydraulic cylinder (110) and the walls of the hydraulic cylinder and the piston rod defining variable cylinder volumes, that the tool (4) is passed in guides (113) along the piston rod's (112) centre line, and that the clamping device (8) is attached to the piston rod (112).

18. A hydrostatic penetration device according to claim 17, characterized in that a first variable cylinder volume (120) is permanently connected to the low pressure chamber (5) and that in this first variable cylinder volume (120) the piston is composed of a first diametrical gradation (122) of the piston rod (112) with a first cross section, that a second variable cylinder volume (121) is alternately connected with the low pressure chamber (5) and the surrounding water, and that in this second variable cylinder volume (121) the piston is composed of a second diametrical gradation (123) of the piston rod (112) with a second cross section which is larger than the first cross section, and that the first and second gradations are arranged in such a manner that the first variable cylinder volume (120) decreases when the second variable cylinder volume (121) increases, and vice versa.

19. A tool for use with a hydrostatic penetration device according to claim 1, especially a sampler for core samples, where the tool (4) is a sampler tube, characterized in that the sampler tube (4) has provided at its lower end a head (55) with two closing jaws (56) hinged to the head with substantially tubular cross section and toothed gripping surfaces which synchronise the closing jaws' movement.

20. A tool for use with a hydrostatic penetration device according to claim 1, especially a sampler for core samples, where the tool (4) is a sampler tube, characterized in that the sampler tube (4) has provided at its lower end a head (58) in the form of a valve housing with a valve plate (59) and an arm (60) which constitutes a one-way valve which in an open position admits water into the sampler tube (4).

* * * * *